US010514193B2

(12) United States Patent
Mitchell

(10) Patent No.: US 10,514,193 B2
(45) Date of Patent: Dec. 24, 2019

(54) REFRIGERATOR APPLIANCE AND ICE MAKER APPARATUS

(71) Applicant: Haier US Appliance Solutions, Inc., Wilmington, DE (US)

(72) Inventor: Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 107 days.

(21) Appl. No.: 15/879,637

(22) Filed: Jan. 25, 2018

(65) Prior Publication Data

US 2019/0226741 A1 Jul. 25, 2019

(51) Int. Cl.

| | |
|---|---|
| ***F25C 1/142*** | (2018.01) |
| ***F25C 1/147*** | (2018.01) |
| ***F25C 5/187*** | (2018.01) |

(52) U.S. Cl.

CPC ..... *F25C 5/187* (2013.01); *F25C 1/142* (2013.01); *F25C 1/147* (2013.01); *F25C 2400/10* (2013.01)

(58) Field of Classification Search

CPC ..... F25C 1/147; F25C 1/142; F25C 2400/10; F25C 5/187

See application file for complete search history.

(56) References Cited

U.S. PATENT DOCUMENTS 3,705,644 A * 12/1972 Kawchitch ..... B65G 33/26 198/664
4,682,475 A 7/1987 Nelson
5,123,260 A 6/1992 Althoff et al.
5,325,679 A * 7/1994 Tatematsu ..... F25C 1/147 62/188
5,501,081 A 3/1996 Mori et al.
5,644,927 A 7/1997 Tatematsu et al.
6,616,737 B1 * 9/2003 Evans ..... B01D 53/0415 96/135
6,691,529 B2 * 2/2004 Sugie ..... F25C 1/147 62/354
9,714,783 B2 * 7/2017 Maroli ..... F25C 1/147
2013/0276472 A1 * 10/2013 Mitchell ..... F25C 1/147 62/344
2017/0234594 A1 * 8/2017 Mitchell ..... F25C 1/147 62/342

FOREIGN PATENT DOCUMENTS

JP 2003021440 A 1/2003
WO WO2000052400 A1 9/2000

* cited by examiner

*Primary Examiner* — Ana M Vazquez
(74) *Attorney, Agent, or Firm* — Dority & Manning, P.A.

(57) ABSTRACT

A refrigerator appliance and ice maker apparatus are included herein. The ice maker apparatus may include a casing, an auger, a discrete flange, and an extruder die. The casing may define a chamber about a central axis. The casing may extend along the central axis between a top portion and a bottom portion. The casing may include a first material. The auger may be disposed within the chamber of the casing. The discrete flange may be selectively mounted on the casing. The discrete flange may include a second material that is unique from the first material. The extruder die may be attached to the discrete upper flange and positioned above the casing.

15 Claims, 12 Drawing Sheets

REFRIGERATOR APPLIANCE AND ICE MAKER APPARATUS

FIELD OF THE INVENTION

The present subject matter relates generally to refrigeration appliances and more particularly to refrigeration appliances including features for making ice.

BACKGROUND OF THE INVENTION

Certain appliances, such as refrigerator appliances, include an ice maker. In order to produce ice, liquid water is directed to the ice maker and frozen. A variety of ice types can be produced depending upon the particular ice maker used. For example, certain ice makers include a mold body for receiving liquid water. An auger within the mold body can rotate and scrape ice off an inner surface of the mold body to form ice nuggets. Such ice makers are generally referred to as nugget style ice makers. Certain consumers prefer nugget style ice makers and their associated ice nuggets.

Existing nugget ice makers often require the mold body to be a large, unitary or single-piece member formed from a highly conductive material. During ice making operations, heat is generally conducted away from water within the mold body. A liquid cooling system is commonly used to draw heat from the mold body. However, such systems may be difficult to assemble or repair. A unitary mold body may be especially difficult and expensive to manufacture. If a liquid cooling system, it is possible that a portion of the liquid cooling system may leak if it is not properly maintained. Moreover, if the icemaker is mounted on a refrigerator door, liquid refrigerant lines to a liquid cooling system may be especially difficult to install or maintain.

Accordingly, ice maker assemblies with one or more easily-assembled and inexpensive features for drawing heat from water to be frozen (e.g., within a mold body) would be useful. It would be further useful if such assemblies were able to use air as a heat exchange medium while still minimizing the energy used to freeze ice nuggets.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an ice maker apparatus is provided. The ice maker apparatus may include a casing, an auger, a discrete upper flange, and an extruder die. The casing may define a chamber about a central axis. The casing may extend along the central axis between a top portion and a bottom portion. The casing may include a first material. The auger may be disposed within the chamber of the casing. The discrete upper flange may be selectively mounted on the casing at the top portion. The discrete upper flange may include a second material that is unique from the first material. The extruder die may be attached to the discrete upper flange and positioned above the casing.

In another exemplary aspect of the present disclosure, an ice maker apparatus is provided. The ice maker apparatus may include a casing, an auger, a discrete flange, an extruder die, and a cooling air duct. The casing may include an inner surface and an outer surface. The inner surface may define a chamber about a central axis. The outer surface may be directed radially outward away from the central axis. The casing may extend along the central axis between a top portion and a bottom portion. The casing may include a first material. The auger may be disposed within the chamber of the casing. The discrete flange may be selectively mounted on the casing at the top portion or the bottom portion. The discrete flange may include a second material that is unique from the first material. The extruder die may be positioned above the auger in fluid communication with the chamber. The cooling air duct may define an air passage extending about the casing. The cooling air duct may define a plurality of air openings in fluid communication with the air passage. The plurality of fins may be in thermal communication with the chamber. The plurality of fins may extend radially outward away from the outer surface of the casing within the air passage.

In a further exemplary aspect of the present disclosure, a refrigerator appliance is provided. The refrigerator appliance may include a housing and an ice maker. The housing may define a chilled chamber. The ice maker may include a casing, an auger, a discrete upper flange, and an extruder die. The casing may define a chamber about a central axis. The casing may extend along the central axis between a top portion and a bottom portion. The casing may include a first material. The auger may be disposed within the chamber of the casing. The discrete upper flange may be selectively mounted on the casing at the top portion. The discrete upper flange may include a second material that is unique from the first material. The extruder die may be attached to the discrete upper flange and positioned above the casing.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
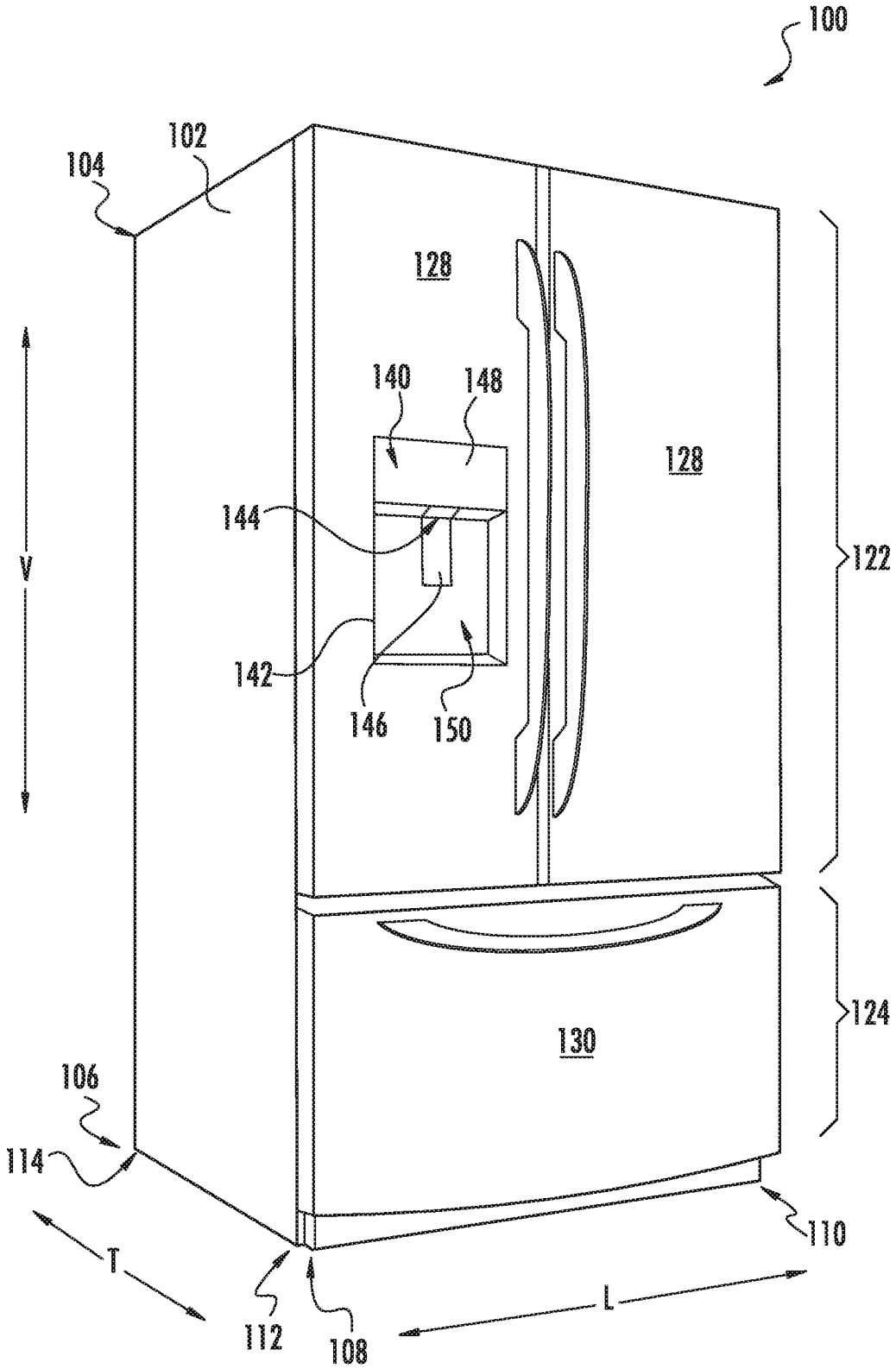
FIG. 1 provides a perspective view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. Furthermore, as used herein, terms of approximation, such as "approximately," "substantially," or "about," refer to being within a ten percent margin of error.

Figure 2:
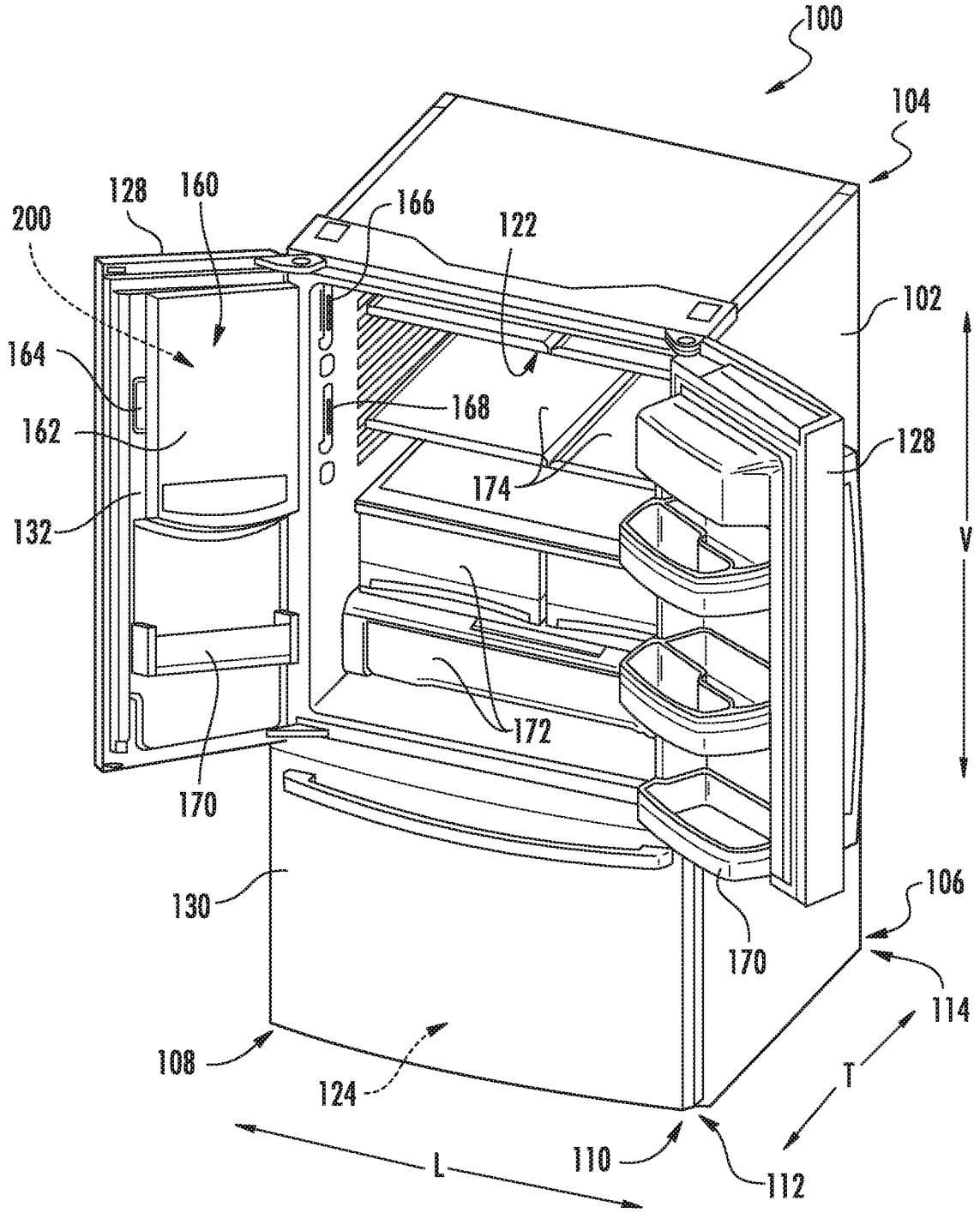
FIG. 2 provides a perspective view of the exemplary refrigerator appliance shown in FIG. 1, wherein a refrigerator door is in an open position according to exemplary embodiments of the present disclosure.
Figure 3:
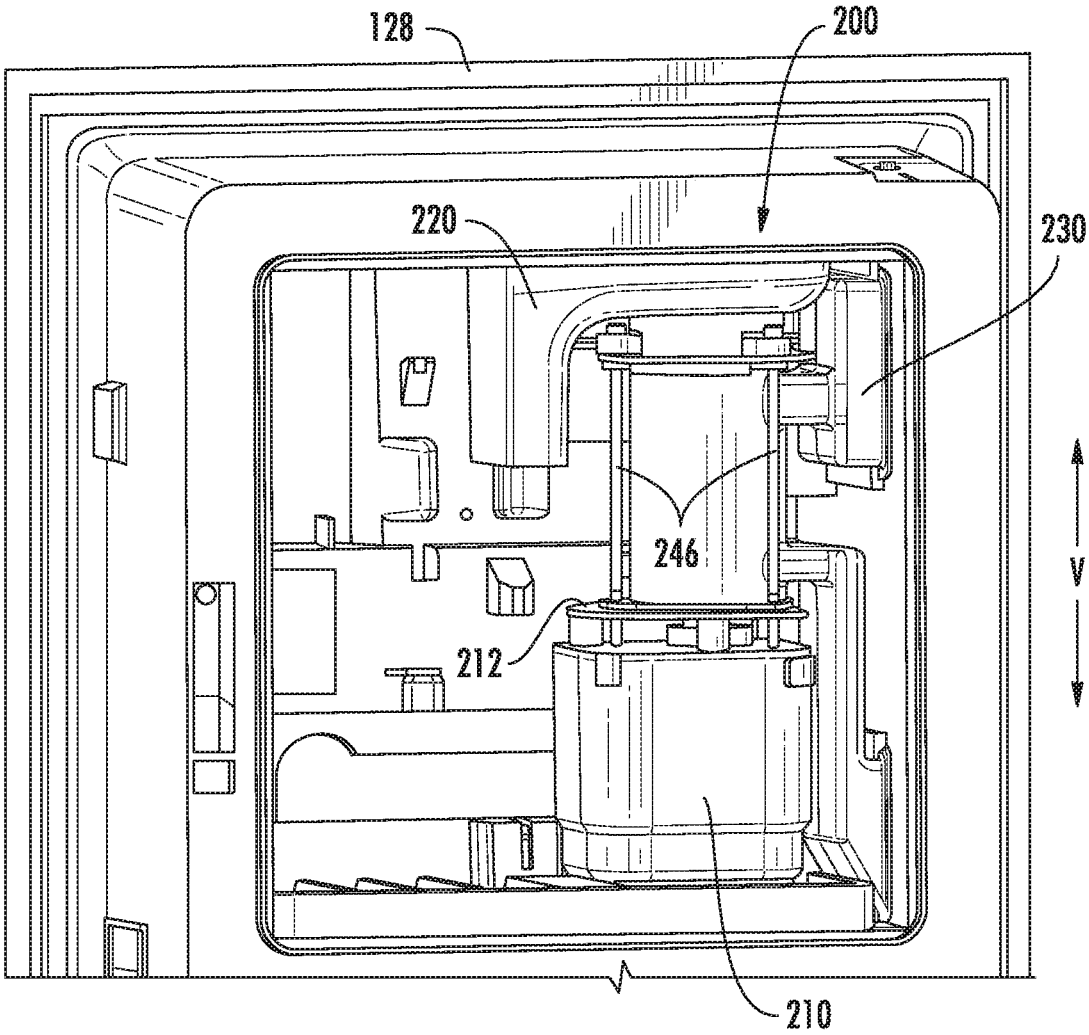
FIG. 3 provides a perspective view of an internal portion of a refrigerator door of an exemplary refrigerator appliance embodiment, including an ice making assembly.
Figure 4:
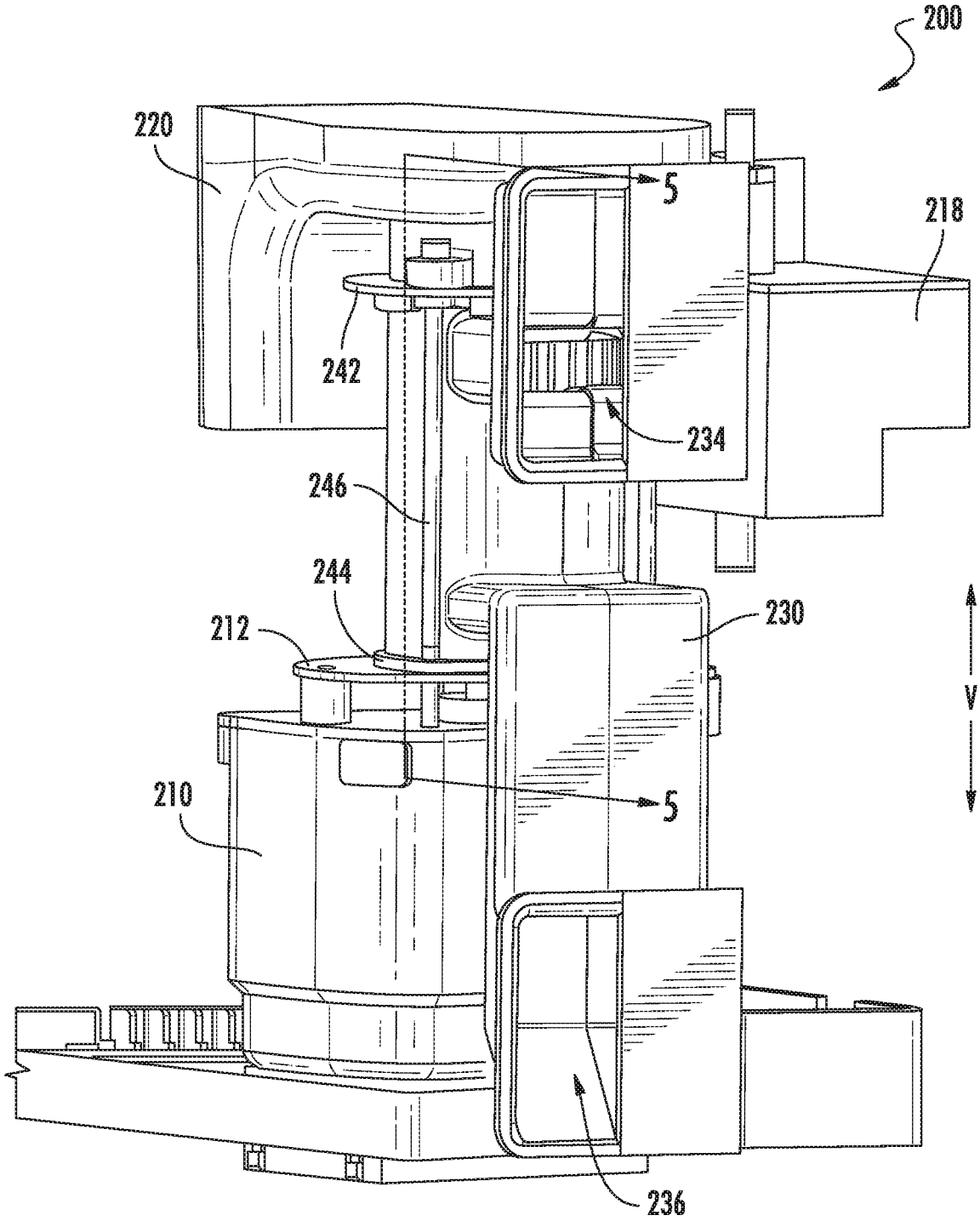
FIG. 4 provides a perspective view of the exemplary ice making assembly embodiment of FIG. 3.

Turning to the figures, FIGS. 1 and 2 illustrate a perspective view of an exemplary appliance (e.g., a refrigerator appliance 100) that includes an ice making feature. Refrigerator appliance 100 includes a cabinet or housing 102 that extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another. Although shown as a refrigerator appliance 100, it is noted that another appliance, such as a stand-alone ice maker, may be provided without departing from the scope of the present disclosure.

As shown, housing 102 defines chilled chambers for receipt of food items for storage. In particular, housing 102 defines fresh food chamber 122 positioned at or adjacent top 104 of housing 102 and a freezer chamber 124 arranged at or adjacent bottom 106 of housing 102. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

According to the illustrated embodiment, various storage components are mounted within fresh food chamber 122 to facilitate storage of food items therein as will be understood by those skilled in the art. In particular, the storage components include bins 170, drawers 172, and shelves 174 that are mounted within fresh food chamber 122. Bins 170, drawers 172, and shelves 174 are positioned to receive of food items (e.g., beverages or solid food items) and may assist with organizing such food items. As an example, drawers 172 can receive fresh food items (e.g., vegetables, fruits, or cheeses) and increase the useful life of such fresh food items.

Refrigerator doors 128 are rotatably hinged to an edge of housing 102 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

Refrigerator appliance 100 also includes a delivery assembly 140 for delivering or dispensing liquid water or ice. Delivery assembly 140 includes a dispenser 142 positioned on or mounted to an exterior portion of refrigerator appliance 100 (e.g., on one of refrigerator doors 128). Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A control panel 148 is provided for controlling the mode of operation. For example, control panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open refrigerator doors 128. In the exemplary embodiment, dispenser recess 150 is positioned at a level that approximates the chest level of a user. As described in more detail below, the dispensing assembly 140 may receive ice from an icemaker disposed in a sub-compartment of the fresh food chamber 122.

FIG. 2 provides a perspective view of a door of refrigerator appliance 100 shown with refrigerator doors 128 in the open position. As shown, at least one door 128 includes a door liner 132 defining a sub-compartment (e.g., icebox compartment 160). Icebox compartment 160 extends into fresh food chamber 122 when refrigerator door 128 is in the closed position. Although icebox compartment 160 is shown in door 128, additional or alternative embodiments may include an icebox compartment defined within door 130. As discussed in greater detail below, an ice making assembly or icemaker 200 may be positioned or disposed within icebox compartment 160. Ice may be supplied to dispenser recess 150 (see FIG. 1) from the icemaker 200 in icebox compartment 160 on a back side of refrigerator door 128.

An access door (e.g., icebox door 162) may be hinged to icebox compartment 160 to selectively cover or permit access to opening of icebox compartment 160. Icebox door 162 permits selective access to icebox compartment 160. Any manner of suitable latch 164 is provided with icebox compartment 160 to maintain icebox door 162 in a closed position. As an example, latch 164 may be actuated by a consumer in order to open icebox door 162 for providing access into icebox compartment 160. Icebox door 162 can also assist with insulating icebox compartment 160 (e.g., by thermally isolating or insulating icebox compartment 160 from fresh food chamber 122). Icebox compartment 160 may receive cooling air from a chilled air supply duct 166 and a chilled air return duct 168 disposed on a side portion of housing 102 of refrigerator appliance 100. In this manner, the supply duct 166 and return duct 168 may recirculate chilled air from a suitable sealed cooling system through icebox compartment 160. An air handler 176 (see FIG. 5), such as a fan or blower, may be provided to motivate and recirculate air. As an example, air handler 176 can direct chilled air from an evaporator of a sealed system through a duct to compartment 160.

Turning to FIGS. 3 through 14, ice making assembly 200 is positioned or disposed within sub-compartment 160. Ice making assembly 200 includes a mold body or casing 202. Casing 202 is generally provided as a hollow cylindrical member that has an opposing inner face 207 and outer face 209 positioned about a defined central axis A. Thus, inner face 207 defines a chamber 204 enclosed about the central axis A. Outer face 209, by contrast, is directed away from chamber 204 and central axis A (e.g., in a radial direction R). As shown, casing 202, including inner face 207 and outer face 209, extends along the central axis A between a top portion 206 and a bottom portion 208.

As will be described in greater detail below, multiple discrete members are mounted or attached to casing 202 to facilitate or aid in ice-making operations. For instance, an auger 214 is rotatably mounted within chamber 204 and casing 202. A motor 210 is attached to casing 202 (e.g., at the bottom portion 208) and is disposed in mechanical communication with (e.g., operably connected or coupled to) auger 214. An extruder die 216 is attached to casing 202 at the top portion 206 of casing 202. A reservoir 218 for holding water may be positioned on or adjacent to casing 202 and in fluid communication with the chamber 204 (e.g., via one or more suitable pipes or fluid conduits). Water from reservoir 218 may thus be supplied directly or indirectly to chamber 204, such as at the bottom portion 208 of casing 202.

Generally, motor 210 is configured for selectively rotating auger 214 in the mold body within casing 202 (e.g., after water has been supplied to chamber 204 from reservoir 218 or another suitable water source). During rotation of auger 214 within the mold body or casing 202, auger 214 scrapes or removes ice off the inner face 207 of casing 202 and directs such ice to extruder die 216. At extruder die 216, ice nuggets are formed from ice within casing 202. In some embodiments, an ice bucket or ice storage bin (not pictured) is positioned below extruder die 216 and receives the ice nuggets from extruder die 216. For instance, an ice chute 220 may be positioned adjacent to extruder die 216 to direct ice from extruder die 216 to ice bin. From ice storage bin, the ice nuggets can enter delivery assembly 140 and be accessed by a user as discussed above. In such a manner, ice making assembly 200 can produce or generate ice nuggets.

Figure 5:
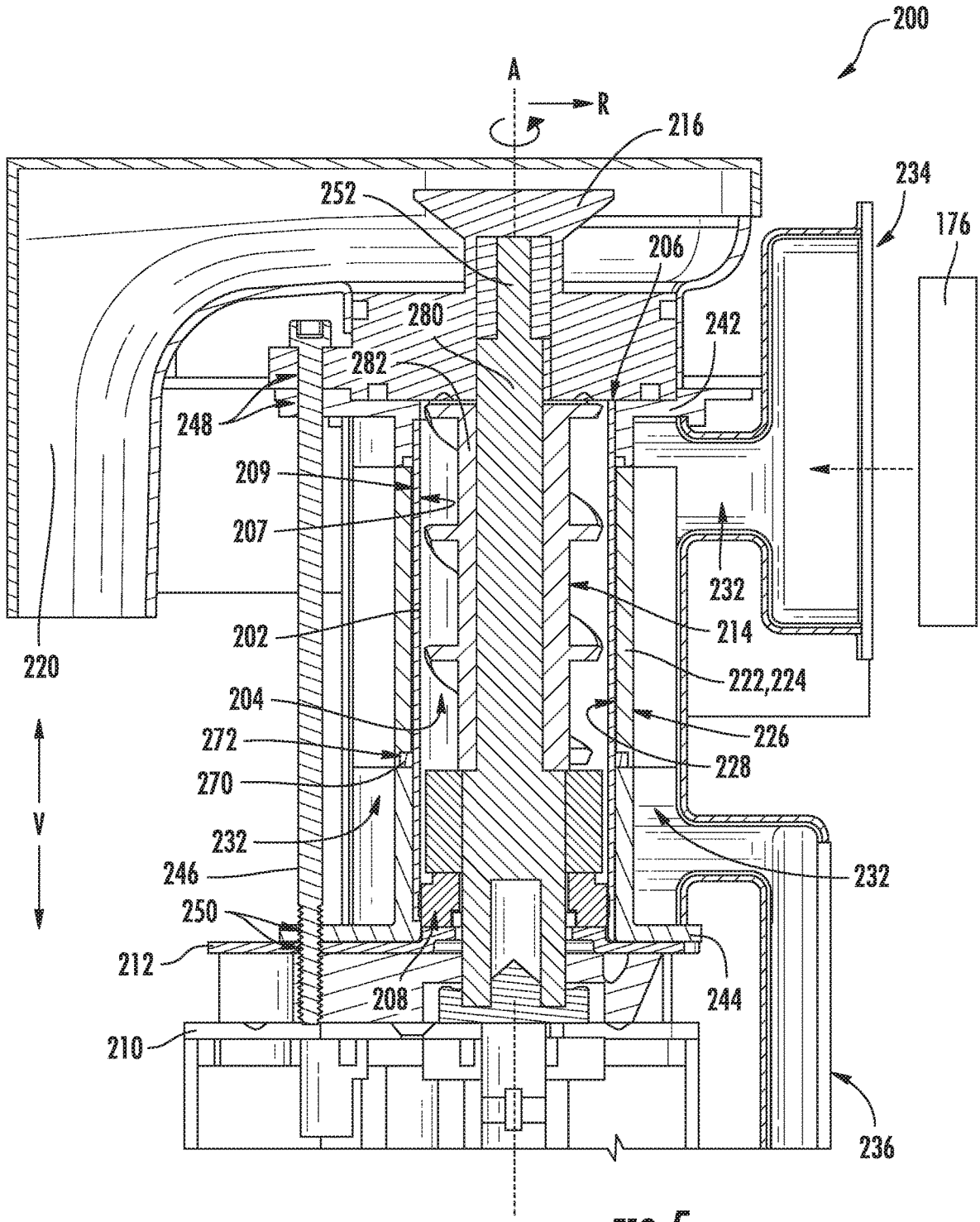
FIG. 5 provides a cross-sectional side view of the exemplary ice making assembly embodiment of FIG. 4, taken along the line 5-5.

Turning briefly to FIGS. 1 and 5, operation of ice making assembly 200 may be controlled by a processing device or controller 190 that, for example, may be operatively coupled to control panel 148 (FIG. 1) for user manipulation to select features and operations of ice making assembly 200. Controller 190 can operate various components of ice making assembly 200 to execute selected system cycles and features. For example, controller 190 is in operative communication with motor 210 and air handler 176. Thus, controller 190 can selectively activate and operate motor 210 and air handler 176 according to one or more desired operations.

Controller 190 may include a memory and microprocessor, such as a general or special purpose microprocessor operable to execute programming instructions or micro-control code associated with operation of ice making assembly 200. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor, e.g., using a combination of discrete analog or digital logic circuitry (such as switches, amplifiers, integrators, comparators, flip-flops, AND gates, and the like) to perform control functionality instead of relying upon software. Motor 210 and air handler 176 may be in communication with controller 190 via one or more signal lines or shared communication busses.

Returning to FIGS. 3 through 15, ice making assembly 200 generally includes one or more discrete flanges 242, 244 that are selectively mounted to the top or bottom portions 206 or 208 of casing 202. In some embodiments, at least two discrete flanges 242, 244 are provided on casing 202. Specifically, an upper flange 242 is selectively mounted on casing 202 at the top portion 206. A lower flange 244 is selectively mounted on casing 202 at the bottom portion 208. Both flanges 242, 244 may be fitted around casing 202 (e.g., such that end portions of casing 202 are received within the flanges 242, 244). When assembled, the flanges 242, 244 may thus bound casing 202 in the radial direction R and, optionally, along the central axis A (e.g., along the vertical direction V).

One or both of the flanges 242, 244 may be formed from a material that is different or unique from the material that forms the casing 202. In other words, casing 202 may include a first material while the flange(s) 242, 244 may include a second material that is unique from the first material. In some embodiments, the first material is a conductive metal. For instance, the first material, which forms casing 202, may be a suitable corrosion-resistant metal (e.g., stainless steel). In additional or alternative embodiments, the second material is an insulating plastic material. As an example, the second material; which forms casing flange(s) 242, 244; may be thermally stable, melt-processable plastic that may withstand the relatively low temperatures of casing 202 (e.g., polyoxymethylene or acetal).

Generally, the flanges 242, 244 may allow one or more members to be attached thereto. As an example, extruder die 216 may be secured to casing 202 (e.g., thereabove along the central axis A or vertical direction V) via upper flange 242. Thus, extruder die 216 may be fixed relative to casing 202 by the mutual attachment of extruder die 216 and casing 202 to upper flange 242.

In exemplary embodiments, one or more bolts 246 hold extruder die 216 to upper flange 242. For instance, the bolts 246 may extend through corresponding axial apertures 248 defined through extruder die 216 and upper flange 242. Each bolt 246 may extend in the vertical direction V, parallel to the central axis A, from a location above extruder die 216 to a location below upper flange 242. Additionally or alternatively, the plurality of bolts 246 (and the axial apertures 248 through which they extend) may be positioned circumferentially about the central axis A, as shown. Optionally, a rotation pin 252 extending from auger 214 may be attached to extruder die 216 (e.g., received therein) to stabilize or guide the rotation of auger 214 below extruder die 216.

One or more mating features may be provided between upper flange 242 and casing 202. For instance, a mated notch-tooth set 254 may be formed on upper flange 242 and casing 202. As shown, particularly at FIG. 9, tooth 254A may be formed on upper flange 242 while notch 254B is defined on a sidewall of casing 202. However, it is understood that the opposite may also be provided. Together, the mated notch-tooth set 254 may restrict circumferential movement of upper flange 242 relative to casing 202. Notably, casing 202 may be held stationary relative to upper flange 242 and auger 214 may be prevented from rotating casing 202 when ice is formed within chamber 204.

As illustrated in FIGS. 3 through 8, in optional embodiments, water reservoir 218 is integrally attached to the discrete upper flange 242 (e.g., as a monolithic unitary member with upper flange 242). For instance, a support arm 219 may extend in the radial direction R outward from upper flange 242 to reservoir 218. Together, upper flange 242, support arm 219, and reservoir 218 may thus provide a single member (e.g., formed from the second material described above).

As illustrated in FIGS. 3, 4, 5, and 7, motor 210 may be secured to casing 202 (e.g., therebelow along the central axis A or vertical direction V) via lower flange 244. Thus, motor 210 may be fixed relative to casing 202 by the mutual attachment of motor 210 and casing 202 to lower flange 244. Optionally, a discrete mounting bracket 212 may be provided between lower flange 244 and motor 210 such that motor 210 is fixed to lower flange 244 via the mounting bracket 212. In some embodiments, mounting bracket 212 is formed as a stamped or cut metal sheet, such as a stainless steel sheet having an axial thickness between 0.05 inches and 1 inch (e.g., approximately 0.09 inches). Notably, the presently-disclosed ice making assembly 200 may utilize a relatively low-powered motor while still generating ice at a suitable rate.

Returning to FIGS. 3 through 12, in exemplary embodiments, one or more bolts 246 hold extruder die 216 to motor 210 (e.g., through mounting bracket 212). For instance, the bolts 246 may extend through corresponding axial apertures 250 defined through mounting bracket 212 and lower flange 244. Each bolt 246 may extend in the vertical direction V, parallel to the central axis A from a location above lower flange 244 to a location below mounting bracket 212. Additionally or alternatively, the plurality of bolts 246 (and the axial apertures 250 through which they extend) may be positioned circumferentially about the central axis A, as shown. Optionally, the same plurality of bolts 246 that secure extruder die 216 to upper flange 242 may secure lower flange 244 to motor 210 (e.g., with or without mounting bracket 212). Thus, each bolt 246 may be radially spaced from the central axis A and extend axially from the upper flange 242 to the lower flange 244. Moreover, each bolt 246 may be in attached engagement with the upper flange 242 and the lower flange 244. For instance, one or more mated bolts 246 or threaded portions may hold bolts 246 to flanges 242, 244. Advantageously, the mutual-attachment of bolts 246 may facilitate easy assembly and ensure alignment of various portions of ice making assembly 200, while also using a relatively small number of attachment elements.

One or more mating features may be provided between lower flange 244 and casing 202. For instance, a mated notch-tooth set 254 may be formed on lower flange 244 and casing 202. As shown, particularly at FIG. 11, tooth 254A may be formed on lower flange 244 while notch 254B is defined on a sidewall of casing 202. However, it is understood that the opposite may also be provided. Together, the mated notch-tooth set 254 may restrict circumferential movement of lower flange 244 relative to casing 202. Notably, casing 202 may be held stationary relative to lower flange 244 and auger 214 may be prevented from rotating casing 202 when ice is formed within chamber 204.

In optional embodiments, an inlet pipe 260 defining a water inlet passage 262 extends integrally from lower flange 244 (e.g., as a monolithic unitary member with lower flange 244). For instance, inlet pipe 260 may extend in the radial direction R outward from lower flange 244. When assembled, inlet pipe 260 may be in fluid communication with the chamber 204 through a radial aperture 266 defined through casing 202. Inlet pipe 260 is radially and circumferentially aligned with radial aperture 266. A separate pipe or tube may fluidly connect inlet pipe 260 to a water source (e.g., reservoir 218). Thus, inlet pipe 260 may direct water from the reservoir 218 to the chamber 204. Optionally, a recessed groove 268 is defined on an inner surface 264 of lower flange 244 about water inlet passage 262 to receive a separate O-ring or gasket (not pictured) positioned about the corresponding radial aperture 266.

As shown, especially in FIGS. 5 through 7 and 10, a heat exchange body 222 may be positioned on or about casing 202. In particular, heat exchange body 222 is disposed in thermal engagement with chamber 204. Generally, heat exchange body 222 includes a base wall 224 that extends along a portion of the casing 202. Base wall 224 may substantially enclose all or some of casing and be connected thereto (e.g., in conductive thermal engagement). For instance, base wall 224 may physically engage casing 202 such that heat is conducted between casing 202 and base wall 224 (e.g., at an interior surface 228 of base wall 224). In some such embodiments, a thermal paste, such as a silicone-based thermal grease (e.g., CHEMPLEX 1381™) may be disposed between interior surface 228 and casing 202. In certain embodiments, interior surface 228 is shaped to generally complement casing 202 (e.g., at outer face 209) in a mated connection. For instance, heat exchange body 222 may be formed as a generally cylindrical body while interior surface 228 is shaped as a cylindrical relief or void to receive the cylindrical body of casing 202.

In some embodiments, a plurality of fins 238 may be provided on base wall 224 and extend radially outward away from the casing 202 (e.g., in the radial direction R from an exterior surface 226 of base wall 224). Each fin 238 is formed from a suitable conductive material. Moreover, each fin 238 may be integral to heat exchange body 222 (e.g., as a monolithic unitary member with body 222). In some such embodiments, the fin 238 integrally-attached or integrally-formed with base wall 224 such that each fin 238 and base wall 224 form a single continuous piece of material, such as a suitable conductive metal (e.g., aluminum). In certain embodiments, fins 238 and base wall 224 are formed from a distinct conductive metal from casing 202. For instance, casing 202 may be formed from a corrosion-resistant metal (e.g., stainless steel) while fins 238 are formed from a different metal having superior thermal conductivity (e.g., aluminum, including alloys thereof).

Ice making assembly 200 may also include a heater 270 (FIG. 5), such as an electric resistance heating element, mounted to casing 202. Heater 270 is configured for selectively heating casing 202 (e.g., when ice prevents or hinders rotation of ice making auger 214 within casing 202). Optionally, heat exchange body 222 may define a complementary groove 272 (e.g., along the interior surface 228 of base wall 224) within which heater 270 sits.

In some embodiments, a cooling air duct 230 encloses at least a portion of casing 202. For instance, cooling air duct 230 may define an air passage 232 within which casing 202 and heat exchange body 222 are held. The plurality of fins 238 may extend within air passage 232 and, optionally, define two or more sub-paths (e.g., along the central axis A) for air flow within air passage 232. As shown, cooling air duct 230 further defines plurality of air openings 234, 236 in fluid communication with the air passage 232. In particular, an air inlet opening 234 and an air outlet opening 236 downstream from air inlet opening 234. Optionally, air inlet opening 234 may be defined above air outlet opening 236. Air received through air opening 234 (e.g., from chilled air supply duct 166—FIG. 2) may thus flow through air passage 232 and to air outlet opening 236 (e.g., and subsequently to chilled air return duct 168—FIG. 2). For example, as shown in FIG. 5, during use, a fan or air 176 may motivate air to air inlet opening 234 before the air is directed downward through air passage 232 and along heat exchange body 222 before being expelled from air outlet opening 236.

Figure 6:
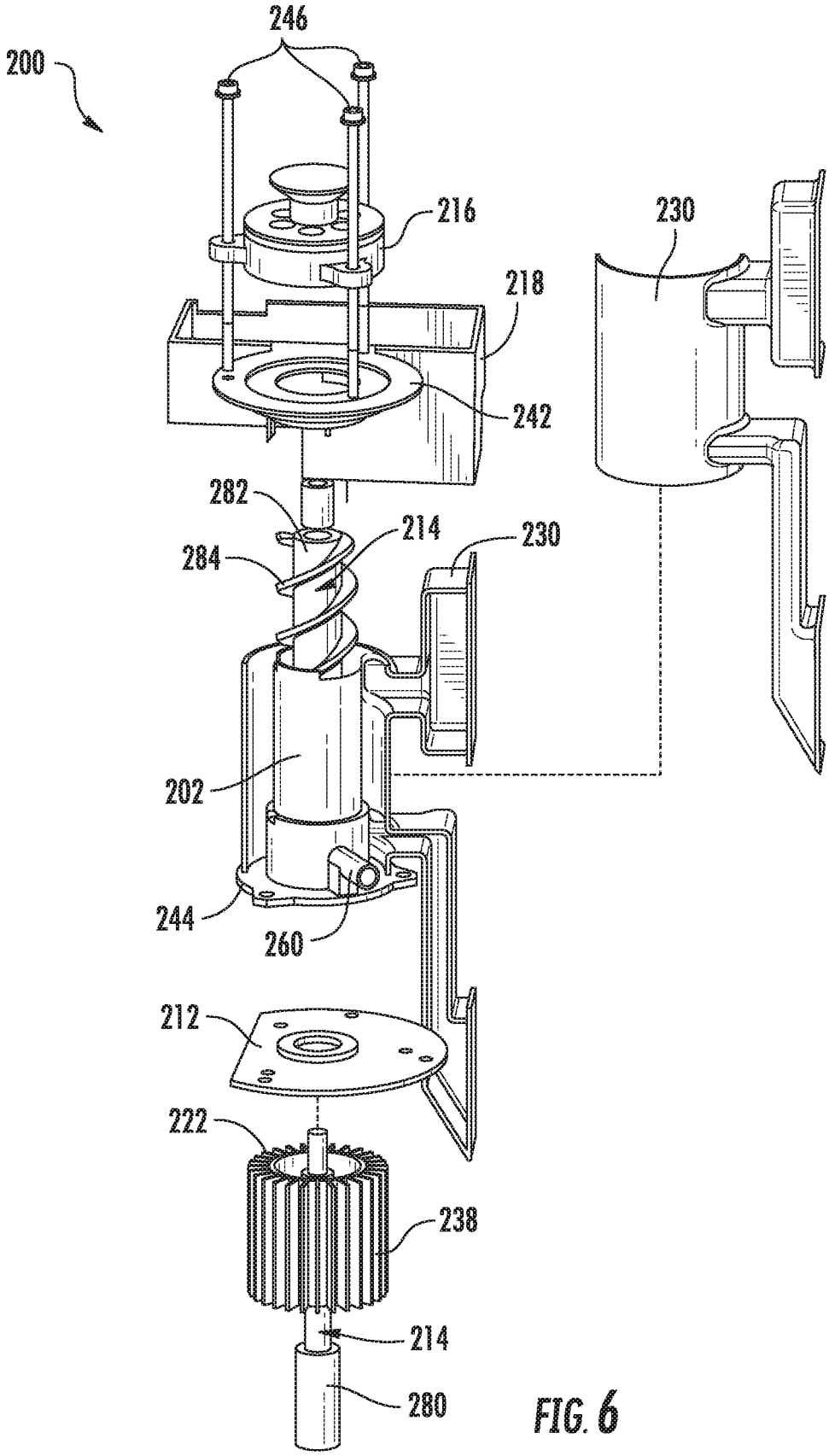
FIG. 6 provides an exploded perspective view of the exemplary ice making assembly embodiment of FIG. 4.
Figure 7:
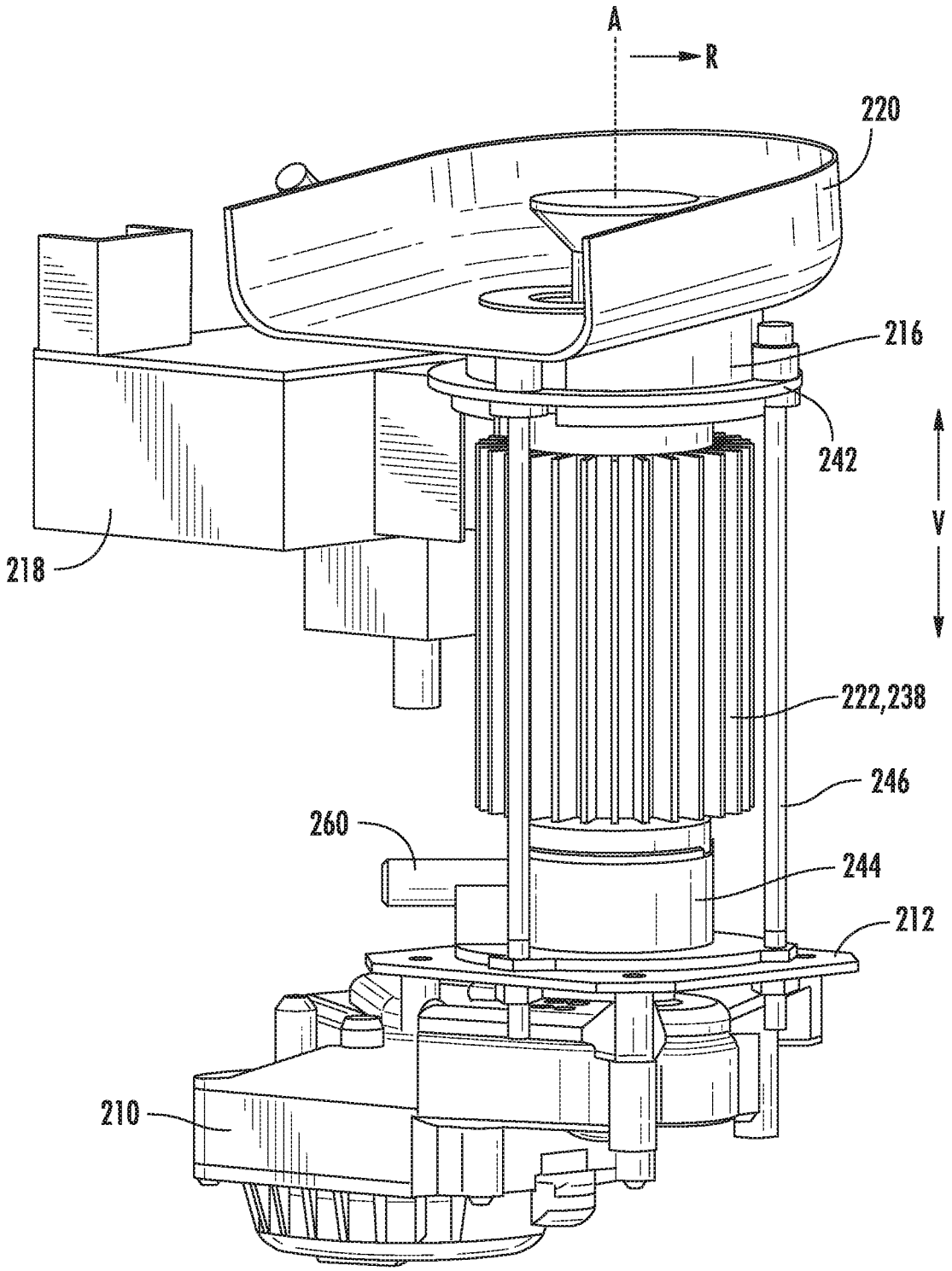
FIG. 7 provides a perspective view of the exemplary ice making assembly embodiment of FIG. 4, wherein the air duct has been removed for clarity.
Figure 8:
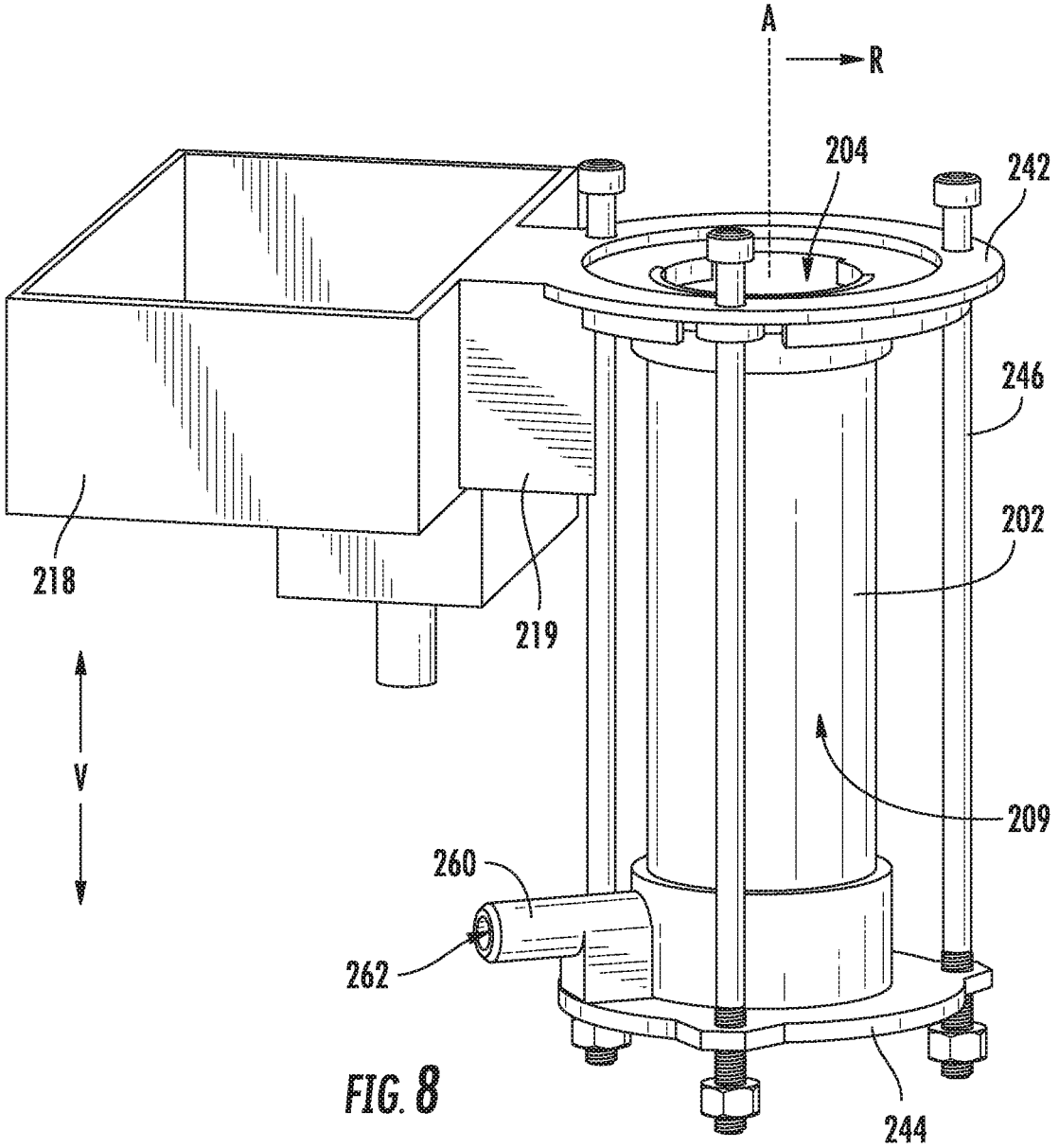
FIG. 8 provides a perspective view of a portion of the exemplary ice making assembly embodiment of FIG. 4, including the casing, upper flange, and lower flange.
Figure 9:
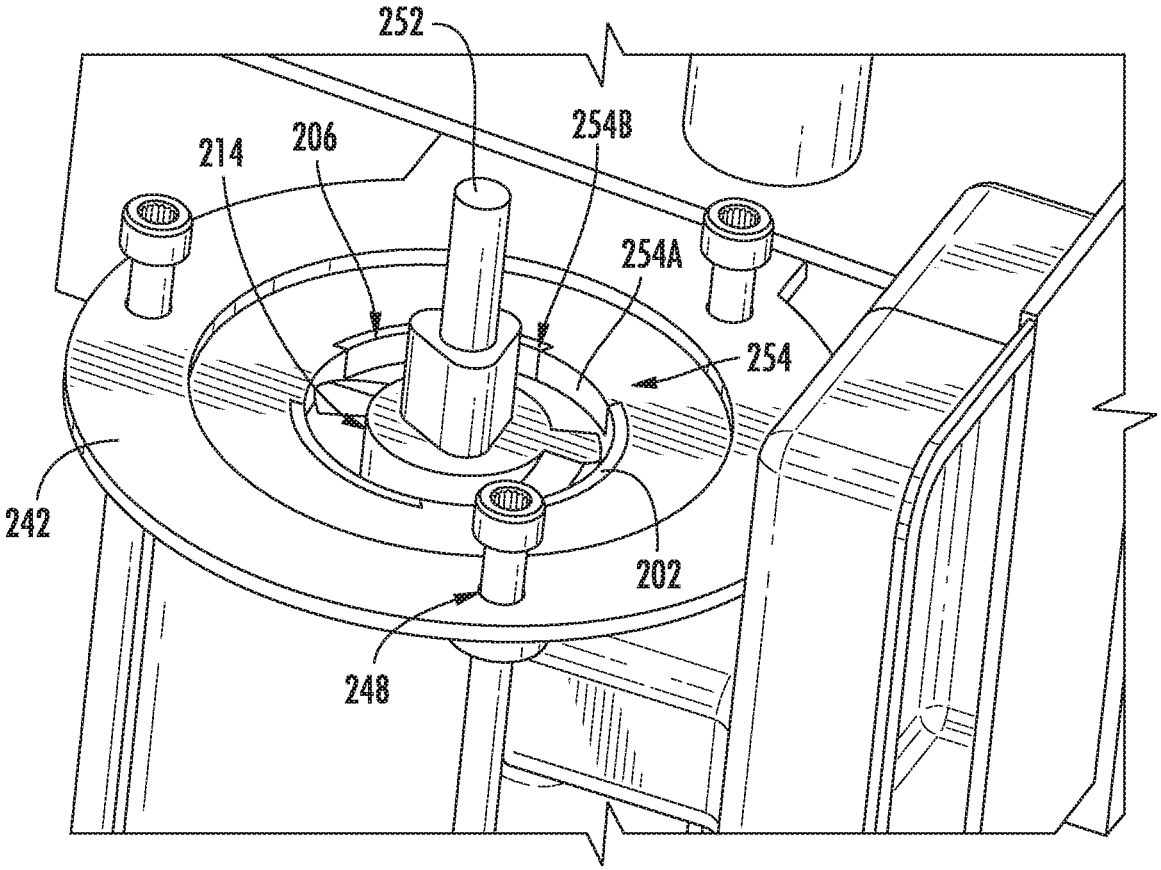
FIG. 9 provides a perspective top view of a portion of the exemplary ice making assembly embodiment of FIG. 4, including the casing, upper flange, and auger.
Figure 10:
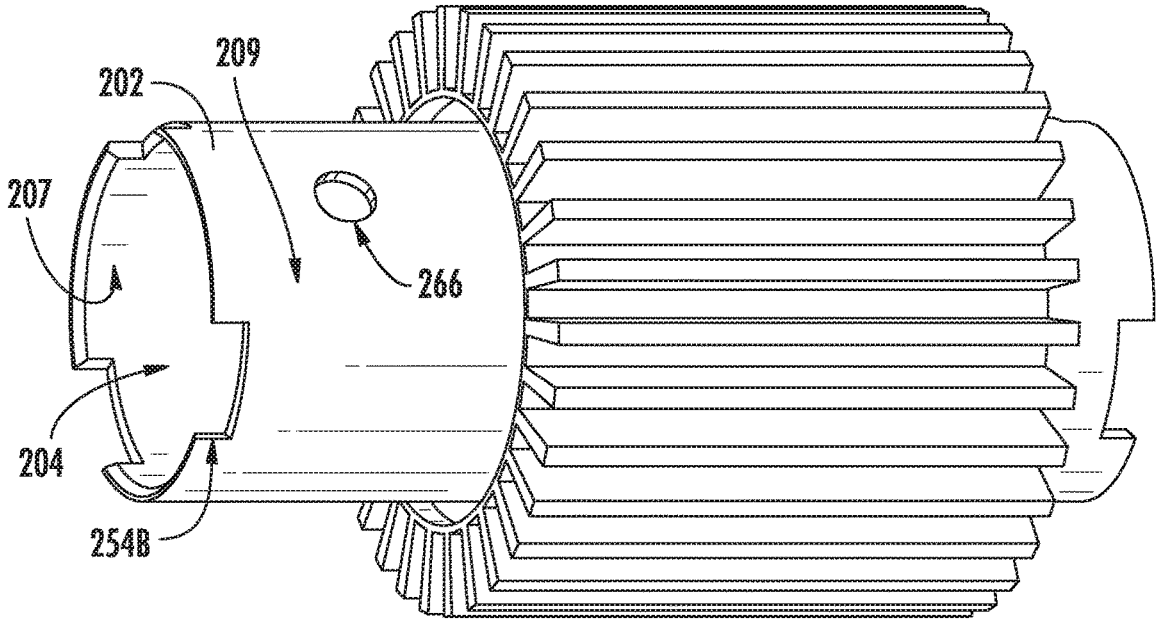
FIG. 10 provides a perspective side view of a portion of the exemplary ice making assembly embodiment of FIG. 4, including the casing and heat exchange body.
Figure 11:
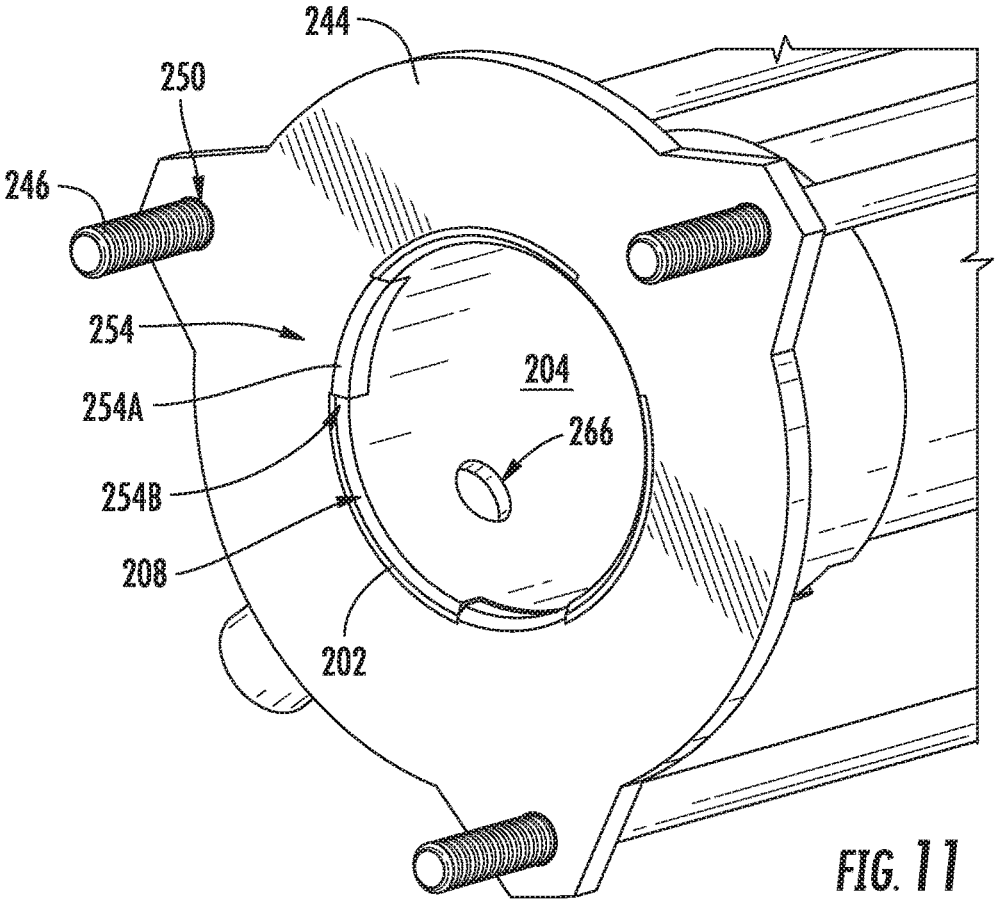
FIG. 11 provides a perspective bottom view of a portion of the exemplary ice making assembly embodiment of FIG. 4, including the casing and lower flange.
Figure 12:
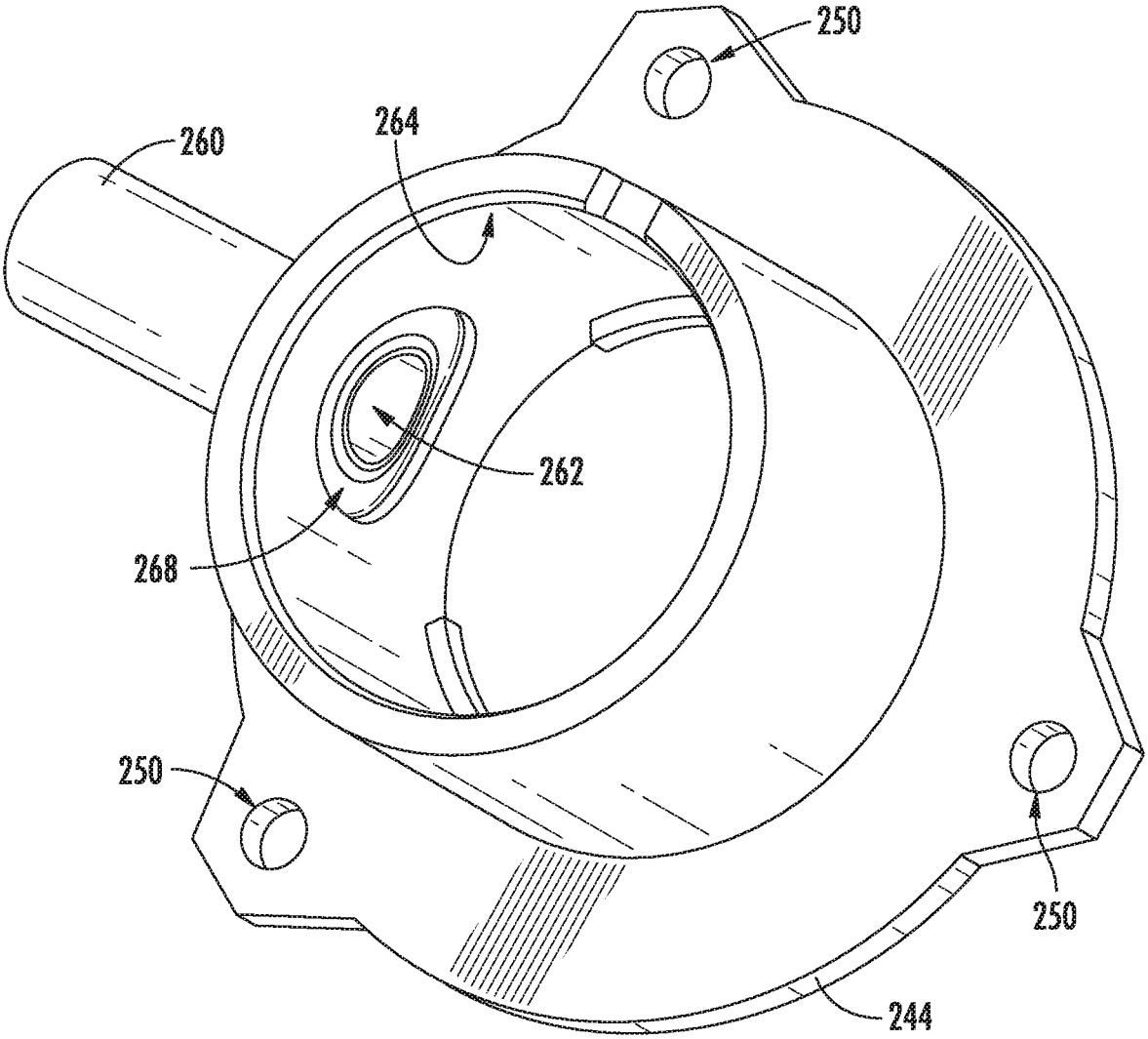
FIG. 12 provides a perspective bottom view of a portion of the exemplary ice making assembly embodiment of FIG. 4, including the lower flange.
Figure 13:
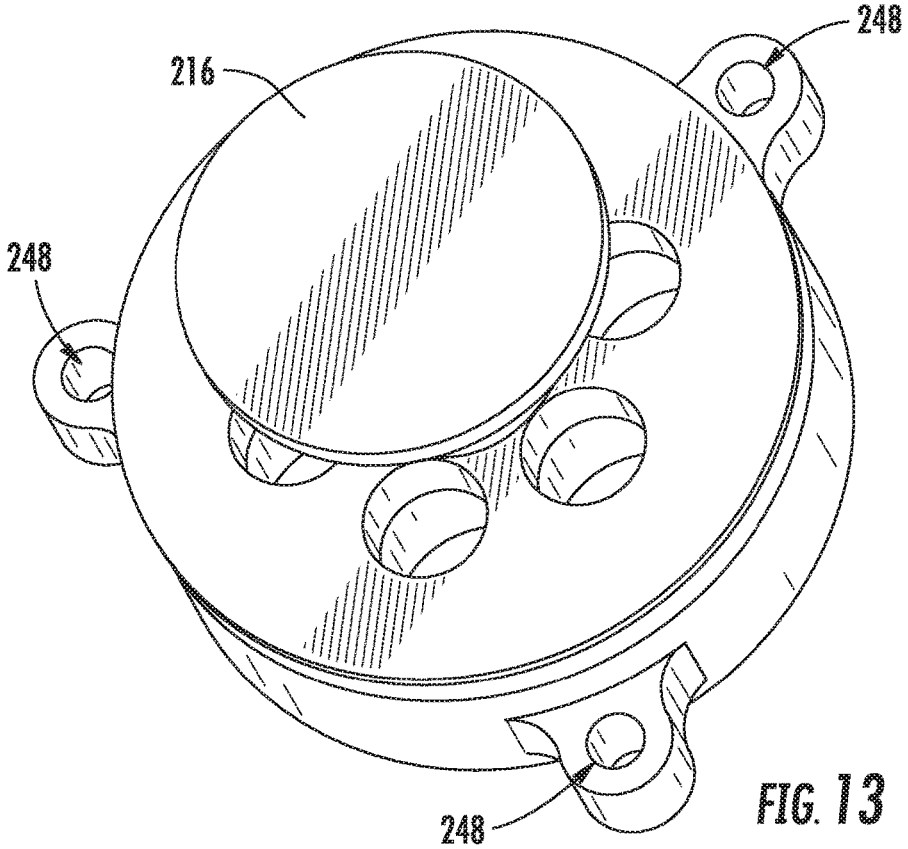
FIG. 13 provides a perspective bottom view of a portion of the exemplary ice making assembly embodiment of FIG. 4, including the extruder.
Figure 14:
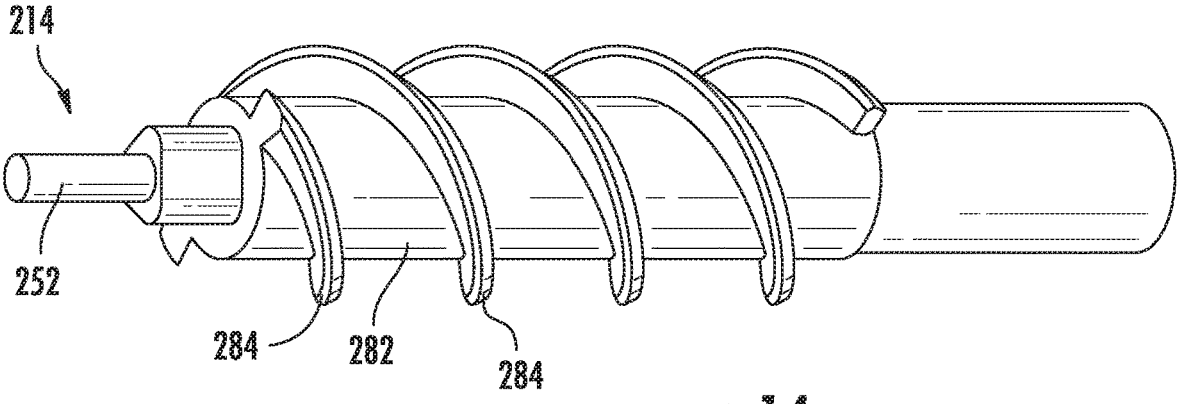
FIG. 14 provides a perspective bottom view of a portion of the exemplary ice making assembly embodiment of FIG. 4, including the auger.

Turning especially to FIGS. 5, 6, and 14, auger 214 generally extends along central axis A. In some embodiments, auger 214 includes multiple discrete members. For instance, auger 214 may include a central shaft 280 and a flight sleeve 282 selectively positioned about the central shaft 280. Flight sleeve 282 includes one or more helical flights 284 that extend radially outward away from central shaft 280 to scrape or motivate ice within chamber 204, as described above. Central shaft 280 may include multiple radial prongs or lobes engaged with complementary internal surfaces of flight sleeve 282 (e.g., the surface opposite of the helical flights 284). Thus, rotation of central shaft 280 (e.g., about the central axis A) similarly rotates flight sleeve 282. In certain embodiments, central shaft 280 and auger 214 are formed from unique or different materials from each other. In other words, central shaft 280 may include one material (i.e., a shaft material) while flight sleeve 282 includes another material (i.e., sleeve material) that is unique from the shaft material. In some embodiments, the shaft material is a conductive metal. For instance, the shaft material, which forms central shaft 280, may be a suitable corrosion-resistant metal (e.g., stainless steel or aluminum, including alloys thereof). In additional or alternative embodiments, the sleeve material is an insulating plastic material. As an example, the sleeve material, which forms flight sleeve 282, may be thermally stable, melt-processable plastic that may withstand the relatively low temperatures of casing 202 (e.g., polyoxymethylene or acetal). Notably, the multi-piece construction may be relatively easy and inexpensive to create and assemble (e.g., in comparison to a single-piece cast member).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice maker apparatus comprising:

a casing defining a chamber about a central axis, the casing extending along the central axis between a top portion and a bottom portion, the casing comprising a first material;

an auger disposed within the chamber of the casing;

a discrete upper flange selectively mounted on the casing at the top portion, the discrete upper flange comprising a second material that is unique from the first material;

an extruder die attached to the discrete upper flange and positioned above the casing;

a discrete lower flange selectively mounted on the casing at the bottom portion, the discrete lower flange comprising the second material; and a plurality of bolts radially spaced from the central axis and extending axially from the discrete upper flange to the discrete lower flange, each bolt of the plurality of bolts extending parallel to the central axis from the top portion to the bottom portion in attached engagement with the upper flange at the top portion and the lower flange at the bottom portion.

2. The ice maker apparatus of claim 1, wherein the first material is a conductive metal material, and wherein the second material is an insulating plastic material.

3. The ice maker apparatus of claim 1, further comprising an inlet pipe extending integrally in the radial direction from the discrete lower flange.

4. The ice maker apparatus of claim 1, wherein the casing and the discrete upper flange define a mated notch and tooth set restricting circumferential movement of the discrete upper flange relative to the casing.

5. The ice maker apparatus of claim 1, further comprising a heat exchange body positioned about the casing, the heat exchange body comprising a plurality of fins extending radially outward away from the casing within an air passage defined along the heat exchange body.

6. The ice maker apparatus of claim 1, further comprising a cooling air duct enclosing the casing, the cooling air duct defining an air passage extending about the casing and a plurality of air openings in fluid communication with the air passage.

7. The ice maker apparatus of claim 1, further comprising a water reservoir in fluid communication with the chamber, the water reservoir being integrally attached to the discrete upper flange and comprising the second material.

8. The ice maker apparatus of claim 1, wherein the auger comprises a central shaft and a flight sleeve selectively positioned about the central shaft, wherein the flight sleeve comprises one or more helical flights extending radially outward away from the central shaft, wherein the central shaft comprises a shaft material, and wherein the flight sleeve comprises a sleeve material that is unique from the shaft material.

9. An ice maker apparatus comprising:

a casing comprising an inner surface and an outer surface, the inner surface defining a chamber about a central axis, the outer surface being directed radially outward away from the central axis, the casing extending along the central axis between a top portion and a bottom portion, the casing comprising a first material;

an auger disposed within the chamber of the casing;

a discrete upper flange selectively mounted on the casing at the top portion, the discrete upper flange comprising a second material that is unique from the first material;

a discrete lower flange selectively mounted on the casing at the bottom portion, the discrete lower flange comprising the second material;

an extruder die positioned above the auger in fluid communication with the chamber;

a cooling air duct defining an air passage extending about the casing and a plurality of air openings in fluid communication with the air passage;

a plurality of fins in thermal communication with the chamber, the plurality of fins extending radially outward away from the outer surface of the casing within the air passage; and a plurality of bolts radially spaced from the central axis and extending axially from the discrete upper flange to the discrete lower flange, each bolt of the plurality of bolts extending parallel to the central axis from the top portion to the bottom portion in attached engagement with the upper flange at the top portion and the lower flange at the bottom portion.

10. The ice maker apparatus of claim 9, wherein the first material is a conductive metal material, and wherein the second material is an insulating plastic material.

11. The ice maker apparatus of claim 9, further comprising an inlet pipe extending integrally in the radial direction from the discrete lower flange.

12. The ice maker apparatus of claim 9, wherein the casing and the discrete upper flange define a mated notch and tooth set restricting circumferential movement of the discrete upper flange relative to the casing.

13. The ice maker apparatus of claim 9, further comprising a water reservoir in fluid communication with the chamber, the water reservoir being integrally attached to the discrete upper flange and comprising the second material.

14. The ice maker apparatus of claim 9, wherein the auger comprises a central shaft and a flight sleeve selectively positioned about the central shaft, wherein the flight sleeve comprises one or more helical flights extending radially outward away from the central shaft, wherein the central shaft comprises a shaft material, and wherein the flight sleeve comprises a sleeve material that is unique from the shaft material.

15. A refrigerator appliance comprising:

a housing defining a chilled chamber; and an ice maker disposed within the housing, the ice maker comprising a casing defining a chamber about a central axis, the casing extending along the central axis between a top portion and a bottom portion, the casing comprising a first material, an auger disposed within the chamber of the casing, a discrete upper flange selectively mounted on the casing at the top portion, the discrete upper flange comprising a second material that is unique from the first material, an extruder die attached to the discrete upper flange and positioned above the casing, a discrete lower flange selectively mounted on the casing at the bottom portion, the discrete lower flange comprising the second material, and a plurality of bolts radially spaced from the central axis and extending axially from the discrete upper flange to the discrete lower flange, each bolt of the plurality of bolts extending parallel to the central axis from the top portion to the bottom portion in attached engagement with the upper flange at the top portion and the lower flange at the bottom portion.

* * * * *